US008292094B2

(12) United States Patent
Morton

(10) Patent No.: US 8,292,094 B2
(45) Date of Patent: Oct. 23, 2012

(54) STORAGE RACK SYSTEM

(76) Inventor: Dan Morton, Buffalo Grove, IL (US)

( * ) Notice: Subject to any disclaimer, the term of this patent is extended or adjusted under 35 U.S.C. 154(b) by 167 days.

(21) Appl. No.: 12/804,458

(22) Filed: Jul. 22, 2010

(65) Prior Publication Data

US 2011/0226712 A1 Sep. 22, 2011

Related U.S. Application Data

(60) Provisional application No. 61/227,726, filed on Jul. 22, 2009.

(51) Int. Cl.
*A47F 7/00* (2006.01)
*A47F 5/08* (2006.01)

(52) U.S. Cl. ..... 211/64; 211/119; 211/106

(58) Field of Classification Search ..... 211/64, 211/70.6, 113, 119, 106, 106.01, 119.009, 211/119.004, 181.1
See application file for complete search history.

(56) References Cited

U.S. PATENT DOCUMENTS 2,643,002 A * 6/1953 Rubenstein ..... 211/106
2,925,916 A 2/1960 Pollock
2,956,689 A 10/1960 Van Der Togt
3,031,069 A 4/1962 Hirsch
3,172,540 A * 3/1965 Berge ..... 211/106.01
3,286,967 A 11/1966 Ferrell
3,391,891 A * 7/1968 Garden ..... 248/311.2
3,477,586 A 11/1969 Haluska
3,789,996 A * 2/1974 Stroh ..... 211/119
3,876,078 A 4/1975 Gomes
3,918,670 A 11/1975 Doherty
4,682,720 A 7/1987 Lucas
4,796,762 A 1/1989 Law
4,884,702 A * 12/1989 Rekow ..... 211/90.02
4,895,334 A * 1/1990 Bajek et al. ..... 248/302
4,986,427 A 1/1991 Law
5,069,350 A 12/1991 Wolff
5,158,186 A 10/1992 Krut
D330,987 S * 11/1992 Rosenthal ..... D6/566
5,181,621 A * 1/1993 Plaehn ..... 211/88.01
5,316,155 A * 5/1994 Collins et al. ..... 211/70.5
5,390,443 A * 2/1995 Emalfarb et al. ..... 47/67
5,482,168 A * 1/1996 Welch et al. ..... 211/106
5,495,969 A 3/1996 Cardenas
5,588,543 A * 12/1996 Finger ..... 211/90.01
5,725,111 A 3/1998 Choi
5,855,283 A * 1/1999 Johnson ..... 211/59.3
5,871,115 A * 2/1999 Kohn ..... 220/485
5,875,902 A * 3/1999 Emery et al. ..... 211/90.03
5,894,940 A * 4/1999 Gusdorf et al. ..... 211/35
5,927,267 A * 7/1999 McKenzie ..... 126/41 R
5,957,308 A 9/1999 Zierenberg
6,152,313 A 11/2000 Klein
2,991,001 A1 10/2001 Frolov
6,386,379 B1 5/2002 Battaglia
6,394,287 B2 5/2002 Cabrera (Continued)

*Primary Examiner* — Jennifer E. Novosad
(74) *Attorney, Agent, or Firm* — Mattingly & Malur, P.C.

(57) ABSTRACT

A storage rack system for storing items along the inside of a door. An open grid rack is attached to the inside of the door and can be used to support various structures configured to hold items such as handguns. Alternatively, a grid, comprised of structures configured as holsters, enables the storage of a large number of handguns in a small area. The open grid rack and the holster grid may be utilized to support items other than guns. The rack assembles are configured to be attached to the inside of a door, such as, for example, a gun safe door, by brackets or by other suitable attachment assemblies.

6 Claims, 4 Drawing Sheets

U.S. PATENT DOCUMENTS

| | | | | |
|---|---|---|---|---|
| 6,405,909 | B1 | 6/2002 | Burnett | |
| 6,412,647 | B1 * | 7/2002 | Ko | 211/106 |
| 6,431,375 | B2 * | 8/2002 | Spencer | 211/106 |
| 6,450,378 | B1 * | 9/2002 | Miller | 224/275 |
| 6,464,086 | B1 | 10/2002 | Klein | |
| 6,464,087 | B1 * | 10/2002 | Klein et al. | 211/35 |
| 6,520,351 | B1 * | 2/2003 | Zadro | 211/119 |
| 6,786,340 | B2 | 9/2004 | Ford | |
| 6,951,289 | B2 | 10/2005 | Scott | |
| 7,118,001 | B2 * | 10/2006 | Klein et al. | 211/90.03 |
| 7,131,546 | B1 | 11/2006 | Price | |
| 7,152,748 | B2 | 12/2006 | Vosbikian | |
| 7,159,727 | B2 * | 1/2007 | Li | 211/106 |
| 7,178,681 | B2 | 2/2007 | Libman | |
| 7,178,769 | B2 | 2/2007 | Magnusson | |
| 7,237,687 | B1 * | 7/2007 | Abdi et al. | 211/119.004 |
| 7,293,662 | B2 | 11/2007 | Klein | |
| 7,293,665 | B1 * | 11/2007 | Hardy et al. | 211/153 |
| 7,374,052 | B2 | 5/2008 | Price | |
| 7,409,790 | B2 | 8/2008 | Stepp | |
| 8,083,079 | B2 * | 12/2011 | Rosen | 211/119.001 |
| 2002/0121294 | A1 * | 9/2002 | Heiberg et al. | 134/184 |
| 2004/0094494 | A1 * | 5/2004 | Klein et al. | 211/119.004 |
| 2004/0140280 | A1 * | 7/2004 | Cleveland et al. | 211/64 |
| 2010/0270246 | A1 * | 10/2010 | Rodriguez | 211/34 |

* cited by examiner

STORAGE RACK SYSTEM

CROSS-REFERENCE TO RELATED APPLICATIONS

This application claims priority to the provisional patent application No. 61/227,726 for "Storage Rack System", filed by the same inventor on Jul. 22, 2009, the disclosure of which is expressly incorporated herein by reference.

FIELD OF THE INVENTION

This invention relates to a storage rack system which is usable to maximize storage within an enclosure having a door. Such an enclosure could be configured as, for example, a closet, a locker, a safe such as a gun safe, or as a similar storage structure. The storage rack system in accordance with the present invention maximizes the storage space within such an enclosure by utilizing an interior surface of the door.

BACKGROUND OF THE INVENTION

It is generally known to attach various article holding devices to the inside of a door to gain additional storage. Such additional storage "solutions" are typically fixed in position on the inside of the door in such a way that they may interfere with usable interior space in the enclosure when the door is closed. Prior storage solutions, which are usable to form additional storage space on the inside of a door, often fail to utilize much of the available surface area on the inside of the door. In addition, such prior storage solutions often do not provide a user configurable storage arrangement nor do they provide features which will fully utilize the unused interior corner space in such a storage structure, when it is situated on the inside of the door or the door frame and particularly above or below the hinges.

Storage structures such as gun safes are quite expensive. It may well be cost-prohibitive for the owner of such a gun safe to upgrade the safe when additional storage space is desired. However, the items an owner of such a gun safe or other safe wishes to protect by storage in such a safe quite frequently will continue to grow. For example, over time, a gun collector will typically purchase more guns and gun accessories. Additionally, other items, such as jewelry, important documents, and other difficult to replace items, will often be stored inside a safe such as, for example, a gun safe. An owner of such a safe, such as a gun safe, thus has a strong interest in being able to maximize the storage capabilities of any such safe.

SUMMARY OF THE INVENTION

The storage rack system, in accordance with the present invention provides a storage rack system that is usable with a safe, such as a gun safe. The storage rack system of the present invention utilizes the relatively close tolerances between a door and door frame to provide a discreet and unobtrusive, yet secure, anchor point which will support a user configurable storage rack system that greatly expands the usable storage space inside of an enclosure such as, for example, a closet, a locker, a safe, and particularly a gun safe, or a similar storage structure. The same benefits result from the use of the storage rack system in accordance with the present invention with larger vaults, which use similar doors that are configured on a larger scale.

The prior art devices are apt to be cumbersome, single use devices and often are space inefficient. Such prior devices are often difficult to install, requiring either great skill, a large amount of time, or both. The prior art often leaves open space which is not usable in the actual storage. The storage rack system in accordance with the present invention overcomes the limitations of the prior art. It is a substantial advance in the art.

BRIEF DESCRIPTION OF THE DRAWINGS

Preferred embodiments of a storage rack system, in accordance with the present invention, are illustrated in the appended drawings and as will be discussed in greater detail in the description of the preferred embodiments, as follows.

DESCRIPTION OF THE PREFERRED EMBODIMENTS

Figure 1:
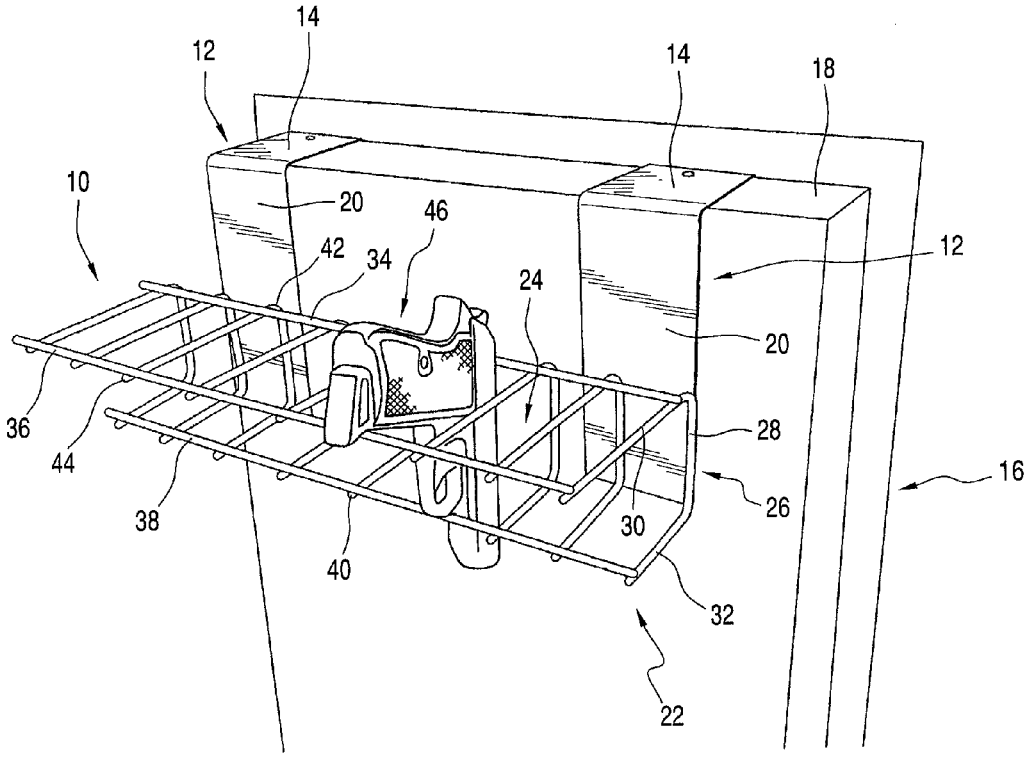
FIG. 1 is a perspective view of a first preferred embodiment of a storage rack system in accordance with the present invention.

Referring initially to FIG. 1, there may be seen, generally at 10, a first preferred embodiment of a storage rack system in accordance with the present invention. The storage rack system 10 of the present invention is comprised of at least first and second spaced, generally L-shaped support brackets 12. Each such support bracket 12 may be constructed of sheet metal, wire, plastic, carbon fibers, or any other substantially rigid material. Each such support bracket, generally at 12 has, at the top, a generally horizontal, planar flange 14 that is usable for anchoring the storage rack system 10 of the present invention to a door, generally at 16. The door 16 may be a gun safe door and has an inner ledge 18 on which the flange 14 of the L-shaped support brackets 14 can be positioned. In one example, the L-shaped support bracket 12 is a 90 degree bend in the material, thus forming an upside down "L" shaped bracket 12, which includes the flange 14 and a vertical bracket leg 20. The bracket flange 14 may be provided having preformed elements for use in securing each such L-shaped support bracket flange 14 to the ledge 18 which is situated on the inside of a door 16, such as a gun safe door. One or more of these L-shaped support brackets 12 may be secured to the top of the door for use in supporting various storage devices, as will be discussed below, along the inside surface of the door. One or more such storage devices, or a number of such storage devices may be attached to the door 16, depending on their relative sizes. Each of the at least two L-shaped support brackets 12 can be releasably attached to the door 16 by any suitable fastening such as a tab, slot, hook, loop, screw, nut, bolt, glue, weld, adhesive, Velcro, or other appropriate structure.

In the first embodiment of the storage rack system of the present invention, a storage rack, generally at 22, and having numerous handgun storage receptacles or "holsters" 24 is suspended, by being connected to, and extending between two laterally spaced ones of the legs 20 of two spaced apart L-shaped support brackets 12. These holsters 24, are formed using a plurality of outwardly facing, generally U-shaped rack members 26, each of which has a base 28, an upper arm 30, and a lower arm 32. At least two of these U-shaped rack members 26 are attached to each of the vertical legs 20 of the L-shaped support brackets 12 such that they each extend horizontally outwardly from an inside surface of the door 16. The plurality of U-shaped rack members 26 are connected to each other, in a horizontally spaced array by two upper tie bar members 34 and 36 and by one lower tie bar member 38 with the lower tie bar member 38 being situated at an outer end 40 of the bottom or lower arm 32 and with the other two upper tie bar members 34 and 36 being secured to inner and outer ends 42 and 44, respectively, of each upper arm 30. Two adjacent ones of the plurality of U-shaped, horizontally spaced rack members 26 define an opening, with a plurality of such openings being used to form the plurality of storage receptacles or holsters 24. These plurality of storage receptacles or holsters 24 are configured to allow a plurality of items, and specifically a plurality of handguns, as depicted at 46, to be stored vertically in a relatively small area near the top of the door 16 of a typical gun safe. Instead of the plurality of U-shaped members 26 depicted in FIG. 1, the receptacles or holsters 24 can be formed by using two individual horizontal rack members equivalent to the upper arms 30 and the lower arms 32. These two horizontal rack members 30, 32 may comprise two separate components which are individually attached to the upper and lower tie bar members 34, 36, 38 and to an additional lower tie bar member, which is not specifically shown.

The first embodiment of the storage rack system can be the unitary component which is shown in FIG. 1 with the members 26 each formed into an approximate U-shape and with the base 28 of the U-shaped member 26 being secured to the vertical leg 20 of the bracket or brackets 12 such that each U-shaped member 26 is oriented horizontally. The three horizontal rack bar members 34, 36 and 38 and one or more of the L-shaped support brackets 12 may also comprise a single integrated or unitary structure. Additionally, another device may be attached to, or suspended from the lower tie bar member 38, thereby providing an additional level of storage locations.

The generally U-shaped members 26 are configured to serve to provide suitable support for items that can be stored using the storage rack system of the present invention. Alternative types of support, in addition to, or instead of the U-shaped members 26 may be used. These alternative types of support can take many forms, such as hooks, elastic, static cups, adjustable cups, rotating cups, or the equivalent. These various types of support may be used individually or in combination. For example, a combination of cups and hooks may be used to support long guns or other elongated articles which are not specifically depicted. The cups may rotate, with respect to their connection to a rack, to support the base of the long gun while the barrel is supported by another type of support, such as, for example, a hook as disclosed above. The rotating cups will also allow a plurality of long guns to be stored along the interior of a safe door while also allowing the safe door to properly close. Storing of long guns along a door of a gun safe allows the interior space of the gun safe to be used for alternative storage, while, at the same time, providing greater access to the long guns which are stored in a storage rack system that is secured to the gun safe door in accordance with the present invention.

In an embodiment of the present invention, which is not specifically depicted, each of the storage devices or holsters 24 is configured having one or more of the L-shaped brackets which can be individually or collectively attached to the top 18 of the door 16 and can thus be used for suspending horizontal receptacle members or holsters 24 which extend beyond an inside edge of the door and on the hinge side of the door. This extended portion of each such horizontal receptacle member or holster 24 will rotate or "turn in" to an area interiorly in the safe and within the inside of the door frame on the hinge side of the frame when the door is closed. This not specifically depicted configuration, as does the similar configuration depicted at 10 in FIG. 1, enables the more efficient utilization of the unused space that is located immediately behind the door frame and on the hinge side of the frame. This otherwise wasted space is thus able to be utilized for additional storage of items, and specifically for the storage of handguns. The horizontal receptacle members, or holsters, generally at 26, allow handguns, such as the one depicted schematically at 46, to be stored vertically, side-by-side and with their muzzles pointing down. This is an efficient and safe use of typically wasted space.

Figure 2:
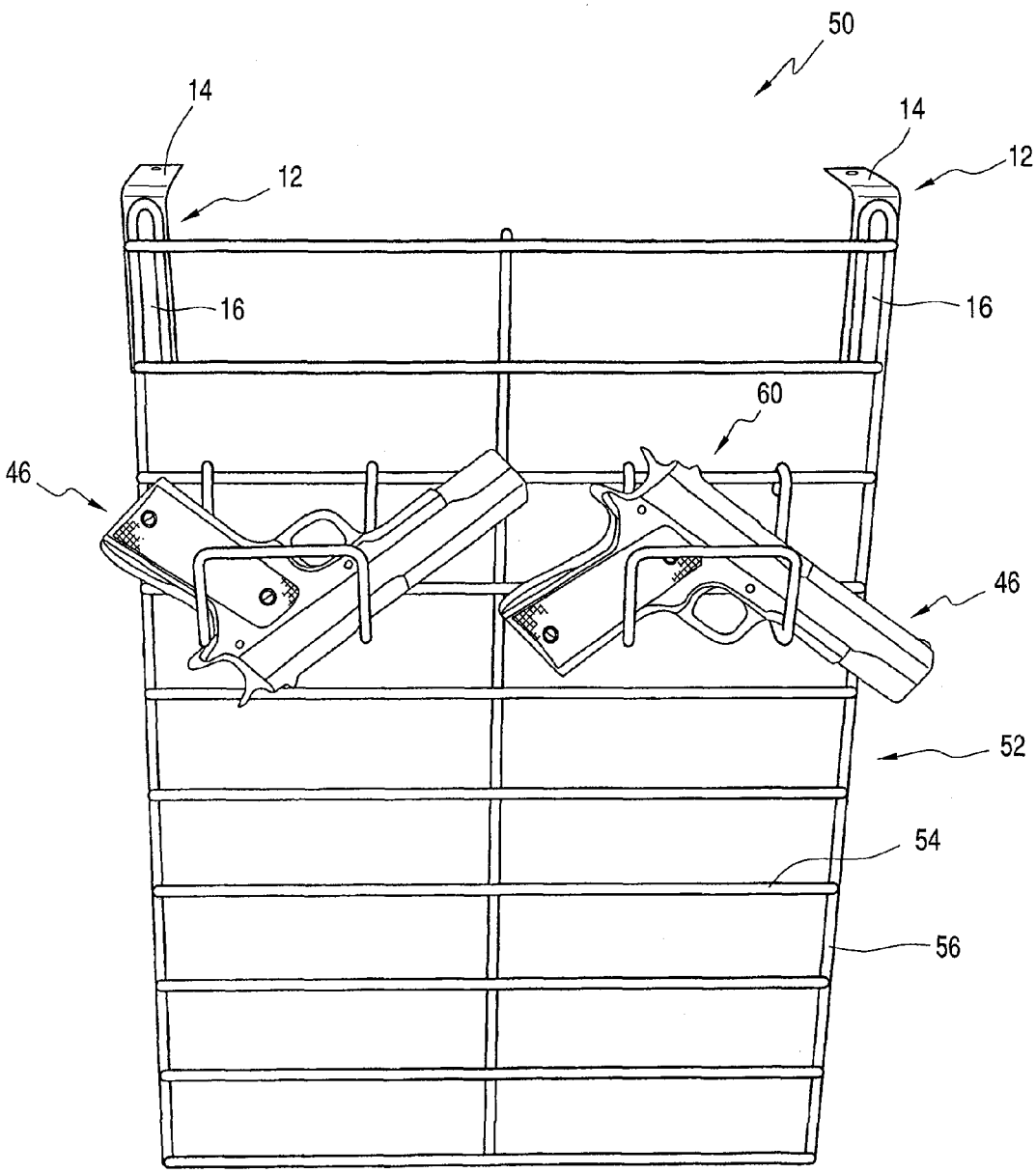
FIG. 2 is a perspective view of a second preferred embodiment of the storage rack system in accordance with the present invention.

In a second preferred embodiment of the storage rack system in accordance with the present invention, and as depicted generally at 50 in FIG. 2, the two generally L-shaped support brackets 12 are connected to an open grid rack, generally at 52. This second preferred embodiment, generally at 50, provides a backing structure or a support grid that is positionable on the inside of the door. Again, one or more of the L-shaped brackets 12 are secured to the top of the door 16. The open grid rack, generally at 52, is structured of a relatively rigid material such as, for example, wire, metal, plastic or other relatively rigid material, and including any perforated sheet material. The rigid grid 52 is attached to the L-shaped brackets, generally 12, by any suitable means, such as welding or the like. The grid 52 is configured using spaced horizontal grid rods 54 and vertical grid rods 56. These grid rods 54 and 56 are joined to each other to form a generally rectangular grid area. To this open grid rack, various attachments can be secured, including, but not limited to, hooks, brackets, document holders, pouches, storage receptacles, pistol holders, rifle holders and other elements that are usable for securing objects to the open grid rack. The second preferred embodiment 50 of the storage rack system and with attachments is shown in FIG. 2. This open grid rack 52 allows the user of the storage rack to utilize the entire inside of the door 16 of the safe. The open grid rack 52 will not obstruct any shelves or partitions which may be contained within the safe. All or portions of the grid can be covered with wires, pegboards, or slat-wall. The user will be able to configure the open grid rack 52 of the second preferred embodiment 50 of the storage rack assembly of the present invention to fit his specific needs.

Figure 3:
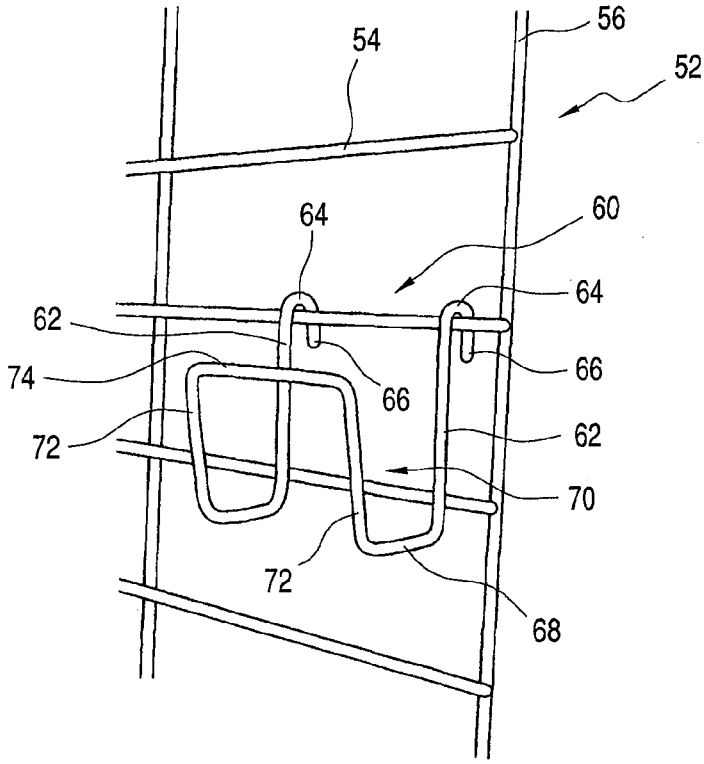
FIG. 3 is a perspective view of a portion of the storage rack system of FIG. 2 and with the handgun depicted in FIG. 2 removed from its pistol hook.
Figure 4:
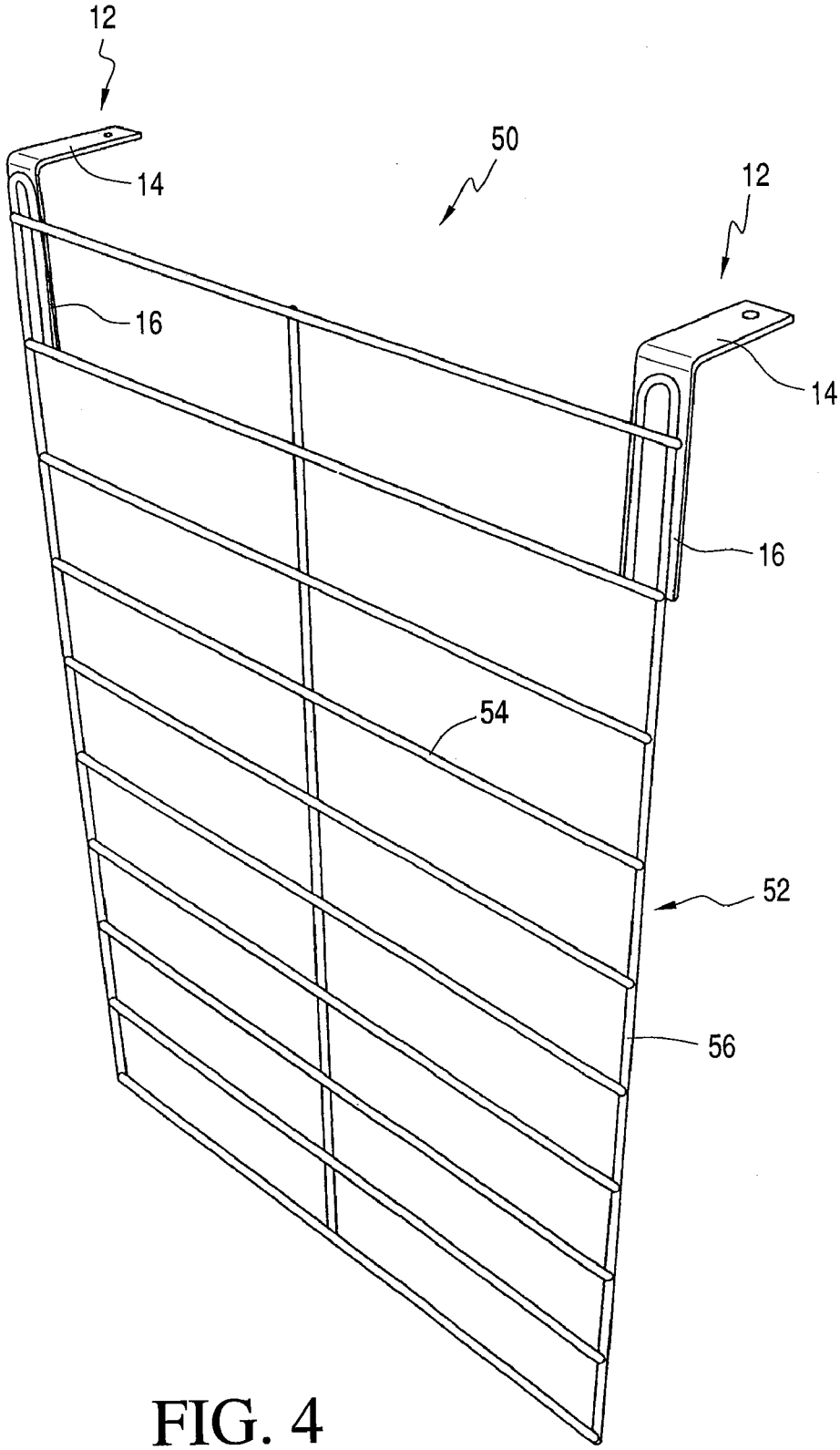
FIG. 4 is a perspective view of the second preferred embodiment of the storage rack system in accordance with the present invention and with no pistol hooks in place.

As may be seen in FIGS. 2 and 3, one or more unitary pistol cradles, generally at 60, can be secured to selected ones of the horizontal grid rods 54 of the storage rack system, generally at 50. Each of these pistol cradles 60 is preferably formed as a unitary assembly which includes a pair of spaced cradle arms 62 which each terminate, at their respective free ends 64, in recurving, horizontal grid rod receiving hooks 66. The cradle arms 62, at their portions remote from their hooks 60 extend generally horizontally as cradle bottoms 68. The two cradle bottoms 68 are connected by an intermediate loop 70 having upturning cradle legs 72 and a transverse upper cradle cross bar 74.

Each pistol cradle, generally at 60, is, as seen in FIG. 2, able to support a handgun 46 in either of two stable positions. Each pistol cradle 60 is sized so that it can receive a handgun 46 that may be equipped with a trigger lock, which is not specifically shown.

The generally L-shaped support brackets 12 which support the storage rack system of the present invention can be secured to the top ledge 18 of a door 16, such as a gun safe door, through various assemblies, including double sided tape, adhesive, magnets, hook and loop fasteners or a simple screw. Such securement will be selected to allow the door of the safe to still function. At the same time, the storage rack system of the present invention allows previously wasted space to be utilized. Many of the securing methods that can be utilized to secure the storage rack assembly to the door of a safe require no special tools and can be accomplished by a user in minimal time.

The storage rack system in accordance with the present invention allows its user to maximize the storage space in an existing space, such as a gun safe, while maintaining the security provided by the gun safe. Furthermore, the subject invention makes accessing the items contained in a closet, locker, safe, or similar storage structure easier and safer. The storage rack system of the present invention protects the items being stored in the gun safe by allowing each item to be stored in a secure manner, untouched by other items, minimizing scratching, dents, or other defects from contact with other items.

What is claimed is:

1. A storage rack system comprising:

at least first and second spaced, generally inverted L-shaped support brackets, each said support bracket including a generally horizontal flange and a generally vertical leg, said horizontal flange of each said support bracket being securable to an interior of a door of an enclosure;

an open grid rack having a plurality of spaced horizontal grid rods and a plurality of spaced vertical grid rods, said horizontal grid rods and vertical grid rods being connected and defining said open grid rack, at least an upper one of said horizontal grid rods being connected to said spaced vertical legs of said at least first and second spaced, generally inverted L-shaped support brackets; and at least one article support cradle attached to a selected one of said horizontal grid rods of said open grid rack, said at least one article support cradle having first and second horizontally spaced cradle arms each terminating in an upper hook end engagable with one of said horizontal grid rods and further having spaced, upturned cradle legs having upper ends joined by a generally horizontal cradle cross bar, said at least one article support cradle being configured to support a pistol.

2. The storage rack system of claim 1, wherein said horizontal grid rods and such vertical grid rods intersect each other at generally right angles.

3. The storage rack system of claim 1, wherein a plurality of said article support cradles are positionable on said open grid rack spaced both vertically and horizontally with respect to each other.

4. The storage rack system of claim 1, wherein said at least one article support cradle is releasably secured to a selected one of said horizontal grid rods by said upper hooks of said first and second horizontally spaded cradle arms.

5. The storage rack system of claim 1, wherein said at least one article support cradle is adapted to receive a pistol selectively in one of first and second positions.

6. A storage rack system comprising:

at least first and second spaced, generally inverted L-shaped support brackets, each said support bracket including a generally horizontal flange and a generally vertical leg, said horizontal flange of each said support bracket being securable to an interior of a door of an enclosure;

a storage rack assembly secured to said spaced legs of at least first and second ones of said inverted L-shaped support brackets;

a plurality of generally horizontally oriented U-shaped members in said storage rack assembly and spaced horizontally from each other in said storage rack assembly, each said U-shaped member including an upper arm and a lower arm and a base, each said upper arm having an upper arm inner end and an upper arm outer end, each said lower arm having a lower arm inner end and a lower arm outer end;

a plurality of horizontally extending tie bar members extending between, and secured to said arms of each of said U-shaped members, said plurality of horizontally extending tie bars and said arms defining a plurality of spaced holsters, each said holster being adapted to receive an article to be supported by said storage rack assembly, said plurality of tie bars including an upper inner tie bar secured to said upper arm inner ends of said U-shaped members, an upper outer tie bar secured to said upper arm outer ends of said U-shaped members and a lower outer tie bar secured to said lower arm outer ends of said U-shaped members.

* * * * *